US005709121A

United States Patent [19]

Camping

[11] Patent Number: 5,709,121

[45] Date of Patent: Jan. 20, 1998

[54] METHOD AND APPARATUS FOR HYDRAULICALLY UPSETTING A STEEL REINFORCEMENT BAR

[75] Inventor: Michael J. Camping, Cote How, England

[73] Assignee: Headed Reinforcement Corporation, Fountain Valley, Calif.

[21] Appl. No.: 668,127

[22] Filed: Jun. 21, 1996

[51] Int. Cl.[6] ..... B21J 5/08

[52] U.S. Cl. ..... 72/316; 72/318; 72/354.2; 72/377

[58] Field of Search ..... 72/318, 316, 322, 72/315, 377, 357, 361, 354.2

[56] References Cited

U.S. PATENT DOCUMENTS

| | | | |
|---|---|---|---|
| 1,983,618 | 12/1934 | Lamond | 72/357 |
| 2,047,766 | 7/1936 | Bruzon | 72/377 |
| 2,442,142 | 5/1948 | Nettenstrom | 72/318 |
| 3,908,430 | 9/1975 | Orain | 72/354.2 |
| 5,134,872 | 8/1992 | Ose | 72/318 |

FOREIGN PATENT DOCUMENTS

| | | | |
|---|---|---|---|
| 1295503 | 5/1962 | France | 72/354.2 |
| 100843 | 8/1980 | Japan | 72/377 |
| 104234 | 6/1984 | Japan | 72/318 |
| 104235 | 6/1984 | Japan | 72/316 |
| 196243 | 10/1985 | Japan | 72/377 |
| 271022 | 10/1989 | Japan | 72/318 |
| 1323193 | 7/1987 | U.S.S.R. | 72/316 |

*Primary Examiner*—Daniel C. Crane
*Attorney, Agent, or Firm*—Morland C. Fischer

[57] ABSTRACT

A method and a portable tool for hydraulically upsetting a steel reinforcement bar (e.g. rebar), one end of which is typically embedded in a concrete or similar structure, so that a relatively wide upset head can be formed at the protruding end to permit the bar to be reliably coupled to an opposing reinforcement bar. The protruding end of the reinforcement bar is first pre-heated and then inserted within the upsetting tool to be clamped between a plurality of articulating jaws. A pair of hydraulic pistons are driven in a first direction through a respective pair of tandem cylinders to correspondingly drive an upsetting block towards and into engagement with the pre-heated end of the reinforcement bar so as to compress the pre-heated end between the jaws and the upsetting block to form the upset head. The hydraulic pistons are then driven in an opposite direction through the tandem cylinders for causing the upsetting block to be withdrawn from the upset head at which time the jaws release the reinforcement bar to be removed from the tool.

20 Claims, 5 Drawing Sheets

Fig. 1
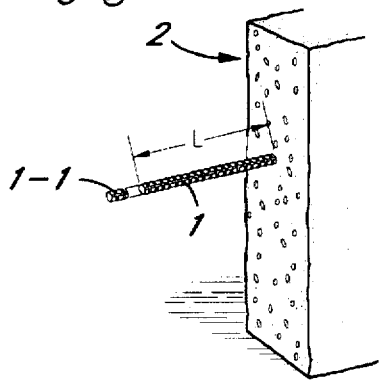
Fig. 2
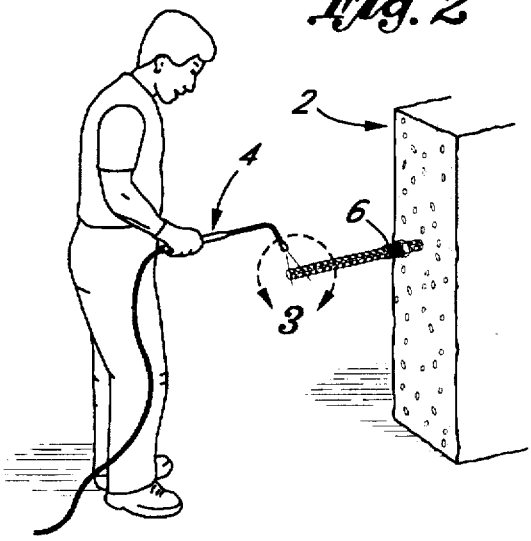
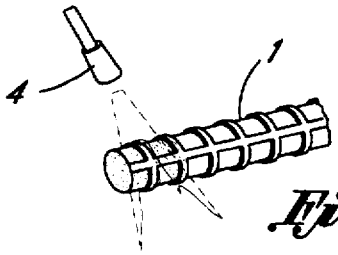
Fig. 3
Fig. 4
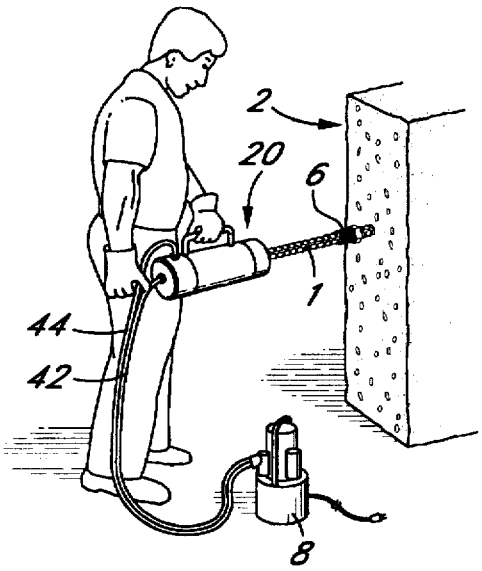
Fig. 5
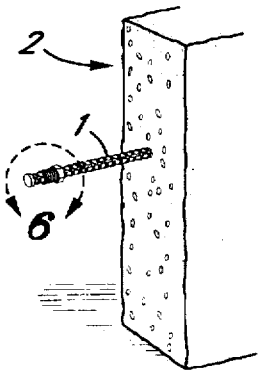
Fig. 6
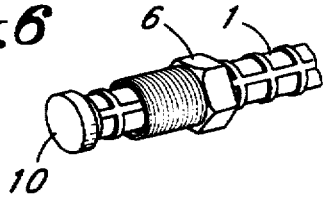

METHOD AND APPARATUS FOR HYDRAULICALLY UPSETTING A STEEL REINFORCEMENT BAR

BACKGROUND OF THE INVENTION

1. Field of the Invention

This invention relates to a portable tool that can be advantageously carried to and used in the field to generate sufficient hydraulic pressure to upset a pre-heated end of a steel reinforcement bar (e.g. rebar), the opposite end of which is typically embedded in a concrete or similar structure, so that the upset end of the bar can be reliably coupled to an opposing reinforcement bar.

2. Background Art

U.S. patent application Ser. No. 08/570,099 filed Dec. 11, 1995 describes a method and a coupling assembly by which to permit a short upstand of steel reinforcement bar (i.e. sometimes known as rebar) that protrudes from an existing concrete structure to be extended at a retrofit work site in the field so as to provide a continuous connection between the existing structure and an adjacent new structure. By way of example, the foregoing enables a new concrete structure to be added to an existing concrete structure so as to prevent the new and existing structures from shifting relative to one another.

The method described in patent application Ser. No. 08/570,099 included a step of forming a relatively large upset head at the protruding end of the reinforcement bar. More particularly, a split forming die is clamped to the upstand and the protruding end thereof is upset by first heating the end and then deforming the end into the shape of the die by means of an electric hammer or hydraulic jack.

However, the aforementioned method of upsetting the reinforcement bar sometimes requires that two workmen be present. Similarly, a certain amount of skill and judgment is required when using an impact tool to mechanically deform the heated end of the reinforcement bar. That is to say, the resulting upset heads formed on different bars usually have different sizes and shapes. In some cases, the upset head is not large enough to be reliably coupled to an opposing reinforcement bar. In other cases, those in the construction industry cannot be certain that the coupled connection of opposing reinforcement bars that extend between existing and new structures will accurately break at the full load capacity of the bars.

SUMMARY OF THE INVENTION

Disclosed are a method and a portable tool for hydraulically upsetting a steel reinforcement bar (e.g. rebar) that is typically embedded in a concrete structure, or the like, so that the protruding end of the bar can be reliably and accurately coupled to an opposing reinforcement bar. A conventional flame cutter first reduces the length of the reinforcement bar to as little as four inches. After a coupling nut is moved over the reinforcement bar, the same flame cutter is used to pre-heat the protruding end of the bar for at least one minute at a temperature of approximately 1100 degrees C. Next, the upsetting tool is positioned to receive the pre-heated end of the reinforcement bar therewithin. The upsetting tool communicates with a hydraulic pump and is adapted to generate hydraulic pressure between 3,000 to 7,000 psi for several seconds to reshape the pre-heated end of the reinforcement bar into a relatively wide upset head. The upsetting tool is then removed, at which point the coupling nut cooperates with the upset end of the reinforcement bar to couple the bar to an opposing bar.

The upsetting tool includes the interconnection of a mouth having a sloping inlet opening, a hollow collar, and a housing. The housing has a plurality of articulating jaws at one end thereof which are adapted to be rotated towards each other and into clamping engagement with the protruding end of the reinforcement bar. Each of the jaws has a pair of chamfers extending axially therealong to define the shape of the upset head. At the opposite end of the housing is a cylindrical body that surrounds a piston body. A pair of tandem cylinders are located within the piston body through which a respective pair of hydraulic pistons are moved. The hydraulic pistons are linked together by a piston rod that carries an upsetting anvil which engages the pre-heated end of the reinforcement bar. A valve body having a pair of oppositely aligned, pressure responsive check valves is located at the rear end of the piston body and functions as a hydraulic piston as the piston body moves through a cylinder at the rear of the cylindrical body of the housing.

In operation, the upsetting tool is moved into position to receive the pre-heated end of the reinforcement bar through the mouth thereof. Hydraulic fluid (e.g. oil) is supplied from the pump to fill the rear cylinder of the housing. The fluid pressure within the rear cylinder increases to urge the piston body forwardly towards the immovable reinforcement rod until the piston body can move no further. In response to the resistance encountered by the piston body, the housing moves rearwardly relative to the piston body. The articulating jaws move rearwardly with the housing to be urged by the sloping inlet opening of the mouth into clamping engagement with the protruding end of the reinforcement bar. When the housing reaches the end of its rearward travel, additional oil added to the rear cylinder of the housing causes one of the check valves in the valve body to open and thereby establish a fluid path to the tandem cylinders. Accordingly, oil is supplied to the tandem cylinders to drive the respective hydraulic pistons therein forwardly towards the reinforcement bar such that the upsetting anvil compresses the pre-heated end and causes the upset head thereof to be shaped within the chamfers of the articulating jaws.

After the upset head is formed, oil is added to the tandem cylinders to drive the respective hydraulic pistons therein rearwardly and away from the upset end of the reinforcement bar. The rearward movement of the hydraulic pistons is imparted to the valve body to cause both the valve body and the piston body to move rearwardly through the rear cylinder of the housing by which to retract the articulating jaws which are free to rotate away from one another to release the upset head of the reinforcement bar. As hydraulic pressure increases within the tandem cylinders, the second check valve opens to establish a fluid path through which oil is drained from each of the cylinders. At the same time, the valve body functions as a piston to cause oil within the rear cylinder of the housing to be expulsed therefrom. The upsetting tool is now withdrawn from the upset reinforcement bar which is now suitable to be reliably and accurately coupled to an opposing reinforcement bar.

BRIEF DESCRIPTION OF THE DRAWINGS

FIGS. 1–6 illustrate the method by which the portable hydraulic upsetting tool of this invention is used in the field to form an upset head at a pre-heated end of a steel reinforcement bar that protrudes from a concrete structure, or the like;

DETAILED DESCRIPTION

Figure 7:
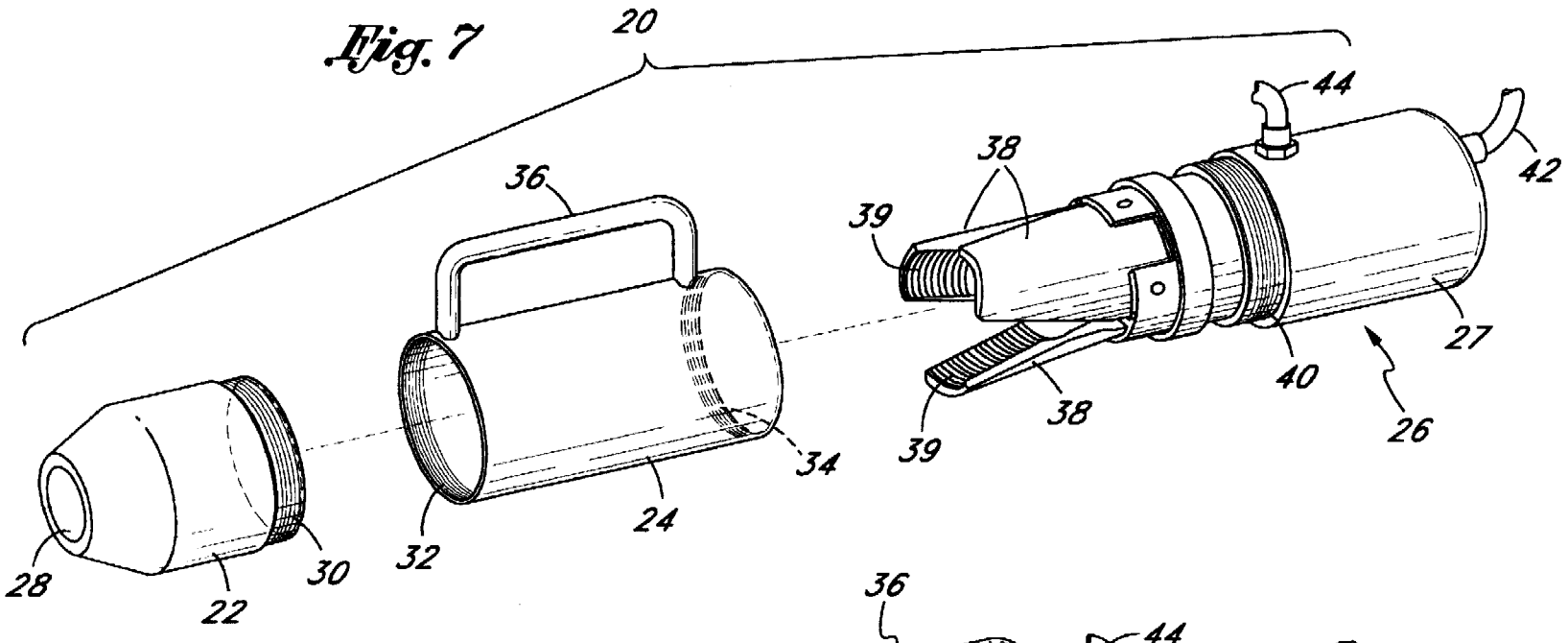
FIG. 7 is an exploded view of the hydraulic upsetting tool used to perform the method illustrated in FIGS. 1–6.

The method and apparatus for hydraulically upsetting a steel reinforcement bar (e.g. rebar) is now described in detail while referring to the drawings. FIGS. 1–6 describe the steps for hydraulically upsetting the protruding end of a reinforcement bar 1 that is embedded in and projects from a concrete or similar structure 2. Initially, the reinforcement bar 1 is shortened to a length that is suitable to receive the soon-to-be described portable hydraulic upsetting tool 20. As one advantage of using upsetting tool 20, the length of reinforcement bar 1 (designated L in FIG. 1) may be as little as four inches. For longer bars, any suitable excess portion (designated 1—1 in FIG. 1) is removed by means of a conventional heating/cutting torch (designated 4 in FIG. 2) such as an oxy/fuel, resistance or induction heating torch.

Next, and as is best shown in FIG. 2, a threaded coupling nut 6 is placed over and moved along the reinforcement bar 1. The coupling nut 6 may be identical to that described in U.S. patent application Ser. No. 08/570,099 which is incorporated herein by reference and which has been or will be assigned to the assignee of this application. Therefore, coupling nut 6 will not be described again. Referring to FIGS. 2 and 3, with the coupling nut 6 moved away from the protruding end of bar 1, the aforementioned heating/cutting torch 4 is used to heat a length of the protruding end of reinforcement bar 1 that is about twice the diameter of the bar. It is preferable to heat the protruding end that is to be upset for at least one minute at a temperature of approximately 1100 degrees C.

FIG. 4 shows the hydraulic upsetting tool 20 being used by a workman to upset the pre-heated protruding end of reinforcement bar 1 so as to form a relatively wide upset head (designated 10 in FIG. 6) that is about 20 to 25% larger in cross-sectional area than the cross-sectional area of the bar 1 before it was upset. More particularly, the upsetting tool 20 applies hydraulic pressure between 3,000 to 7,000 psi to the pre-heated end of reinforcement bar 1 for approximately 5 seconds so that the upset head 10 is sized to be approximately 25 to 50 percent larger than the diameter of the bar. However, it is to be understood that the precise size of the upset head 10 of steel reinforcement bar 1 is not to be considered a limitation of the present invention.

FIGS. 5 and 6 show the reinforcement bar 1 after the upsetting tool 20 has been removed therefrom and the relatively wide upset head 10 has been formed at the protruding end thereof. The coupling nut 6 can now be used in cooperation with the upset head 10 to reliably couple the steel reinforcement bar 1 projecting from the concrete structure 2 to an opposing steel reinforcement bar (not shown) whereby to provide continuous support between structure 2 and an adjacent concrete structure (also not shown). In this regard, a method for coupling the opposing reinforcement bars to one another by means of the upset head 10 of bar 1 is described in the aforementioned patent application Ser. No. 08/570,099.

Figure 7A:
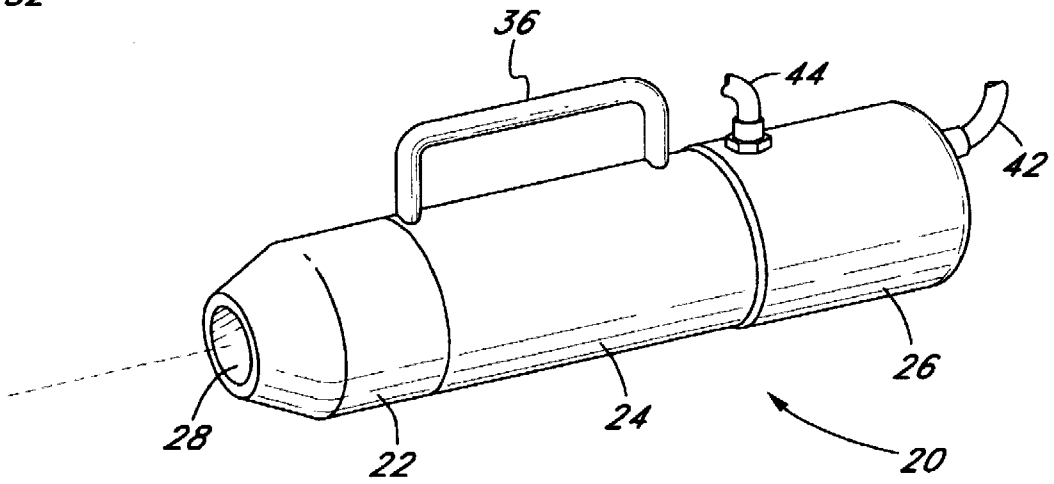
FIG. 7A shows the hydraulic upsetting tool of FIG. 7 in the assembled configuration.

FIGS. 7–11 of the drawings show the portable hydraulic upsetting tool 20 that was referred to in FIGS. 1–6 for forming a relatively wide upset head 10 at the protruding end of a steel reinforcement bar 1 so that the bar 1 can be reliably coupled to an opposing steel reinforcement bar to provide a continuous connection between a pair of adjacent concrete structures. Referring initially to FIGS. 7 and 7*a*, the upsetting tool 20 is shown including the detachable interconnection of a mouth 22, a collar 24 and a housing 26. The mouth 22 is hollow having one end thereof sloping inwardly towards an inlet opening 28 through which the protruding end of a steel reinforcement bar (e.g. 1 of FIGS. 1–6) is inserted after the protruding end has been heated as earlier described. The opposite end of the mouth 22 includes a set of peripheral screw threads 30 extending around the exterior thereof.

The collar 24 of upsetting tool 20 is a hollow cylinder, one end of which having a set of peripheral screw threads 32 extending around the interior thereof. In the assembled relationship of FIG. 7A, the sets of screw threads 30 and 32 around the mouth 22 and the collar 24 are mated together. The opposite end of the collar 24 also has a set of peripheral screw threads 34 extending around the interior thereof. An elongated handle 36 extends longitudinally between the opposite ends of collar 34 to permit the upsetting tool 20 in the assembled relationship of FIG. 7A to be easily transported to and from the field and between job sites.

At one end of the housing 26 of upsetting tool 20 is a plurality of (e.g. three) spring-controlled, articulating jaws 38 that are surrounded by the hollow collar 24. The jaws 38 are preferably manufactured from forged steel or any other suitable hardened material. Each jaw 38 has a set of gripping teeth 39 formed at the inwardly facing side thereof. As will be explained in greater detail hereinafter, the articulating jaws 38 are adapted to be rotated towards and away from one another and to slide axially between the collar 24 and mouth 22 of tool 20 for grasping the projecting end of the reinforcement bar that has been heated and inserted through the inlet opening 28 of mouth 22. A set of peripheral screw threads 40 extends around the exterior of body 26 so that, in the assembled relationship of FIG. 7A, the sets of screw threads 34 and 40 around the collar 24 and housing 26 are mated together. It may now be appreciated that the sets of screw threads 30, 32, 34 and 40 permit the mouth 22, collar 24 and housing 26 to be easily separated from one another when it is necessary to clean or repair the upsetting tool 20.

At the end of the housing 26 opposite articulating jaws 38 is a cylindrical body 27 that is closed by a head 29. A pair of fluid hoses 42 and 44, which are respectively coupled to the head 29 and cylindrical body 27 of housing 26, communicate with a source of hydraulic fluid, such as a pump, or the like (designated 8 in FIG. 4), to permit the upsetting tool 20 to generate sufficient hydraulic pressure to upset the pre-heated protruding end of the steel reinforcement bar 1. By way of example, a double acting, solenoid actuated pump that is suitable for use with the upsetting tool 20 to upset bar 1 is EnerPac Model PUR-3409B.

Figure 8:
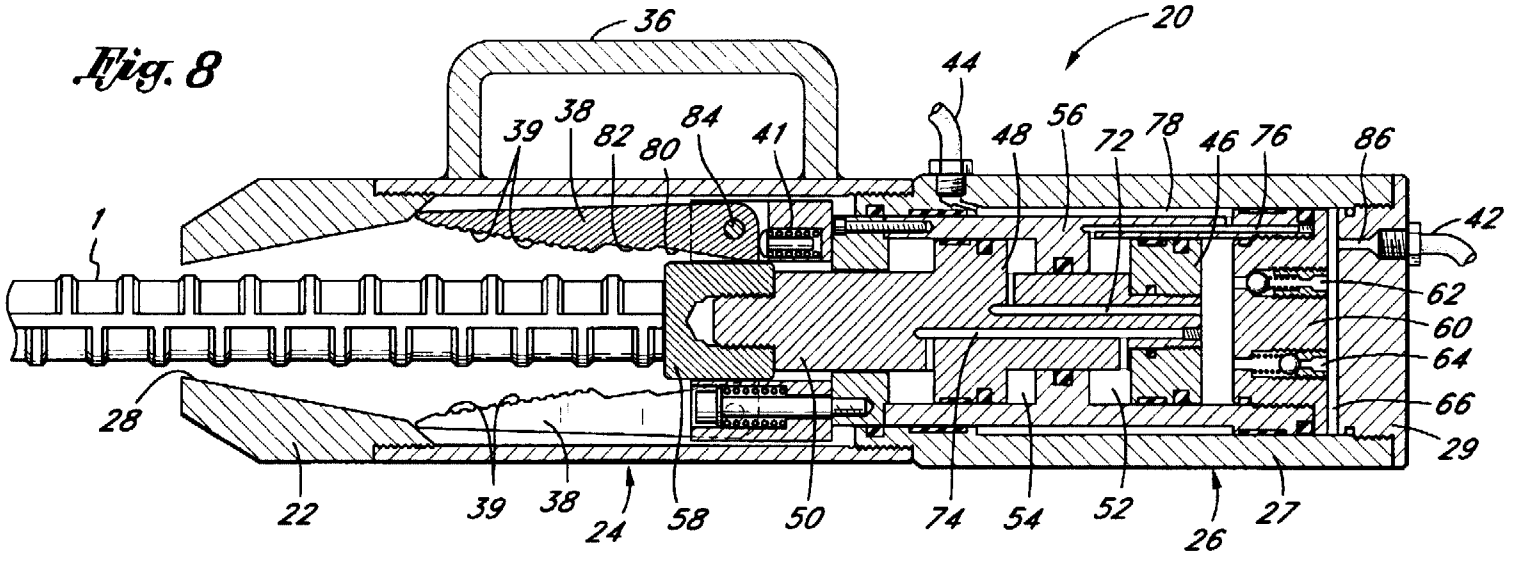
FIG. 8 shows a cross-section of the hydraulic upsetting tool while at rest.

FIG. 8 of the drawings shows the hydraulic upsetting tool 20 after it has been carried into the field and positioned with of respect to an embedded steel reinforcement bar (such as that designated 1 in FIG. 4) so that the pre-heated protruding end of the reinforcement bar is received through the inlet opening 28 of mouth 22 to be surrounded by and spaced from the articulating jaws 38. As it is shown in FIG. 8, the hydraulic upsetting tool 20 is in an at rest condition, such that no hydraulic fluid is being applied via the hoses 42 and 44 to generate hydraulic pressure for upsetting the pre-heated protruding end of the reinforcement bar 1 that has been inserted through the inlet opening 28.

A pair of hydraulic pistons 46 and 48 are disposed at the rear of the cylindrical body 27 of the housing 26 when upsetting tool 20 is at rest. The hydraulic pistons 46 and 48 are linked together in spaced, parallel alignment with one another at the rear end of a common piston rod 50 so that the movement of one piston 46 is imparted to the other piston 48 via piston rod 50. In this regard, the pistons 46 and 48 are adapted for reciprocal movement through respective tandem cylinders 52 and 54 that are formed at the interior of a hollow piston body 56 that is located within and movable through the cylindrical body 27 of housing 26. The front end of piston rod 50 is threaded and mated to a correspondingly threaded upsetting anvil 58 against which the pre-heated end of the incoming reinforcement bar 1 is disposed.

Connected across the rear end of the piston body 56 is a valve body 60. Valve body 60 includes a pair of fluid paths that are controlled by a respective pair of spring biased ball check valves 62 and 64. It should be noted that the check valves 62 and 64 are disposed relative to one another so as to be responsive to pressure differentials at opposite sides of the valve body 60 with respect to the first tandem cylinder 52 and the cylinder 66 at the rear of the cylindrical body 27 of housing 26. The valve body 60 also functions as a hydraulic piston when the piston body 56 moves rearwardly through the rear cylinder 66.

To enable fluid flow to and from the tandem cylinders 52 and 54 of piston body 56, a pair of fluid channels 72 and 74 are formed longitudinally through the piston rod 50. A first of the fluid channels 72 runs between the pair of tandem cylinders 52 and 54 from locations behind each of the hydraulic pistons 46 and 48. The second fluid channel 74 also runs between the pair of tandem cylinders 52 and 54, but from locations in front of the hydraulic pistons 46 and 48. A third fluid channel 76 runs longitudinally through the piston body 56 from the cylinder 52 at a location in front of piston 46 to the fluid hose 44 via a fluid path 78 at the interface of piston body 56 with the cylindrical body 27 of housing 26.

As previously described, in the at rest condition of the upsetting tool 20, each of the spring-controlled articulating jaws 38 of housing 26 is spaced from the protruding end of steel reinforcement bar 1 that has been heated and received through the inlet opening 28 of sloping mouth 22. Each jaw 28 has a pair of serially aligned chamfers extending along the inwardly facing side thereof adjacent gripping teeth 39. As will soon be described, the jaws 28 are adapted to rotate towards one another to grip reinforcement bar 1 therebetween so that the upset head (designated 10 in FIG. 6) of bar 1 can be shaped within the chamfers 80 and 82. To this end, each articulating jaw 38 is rotatably mounted on a pivot pin 84 so as to be rotated therearound in directions towards and away from the bar 1.

Figure 9:
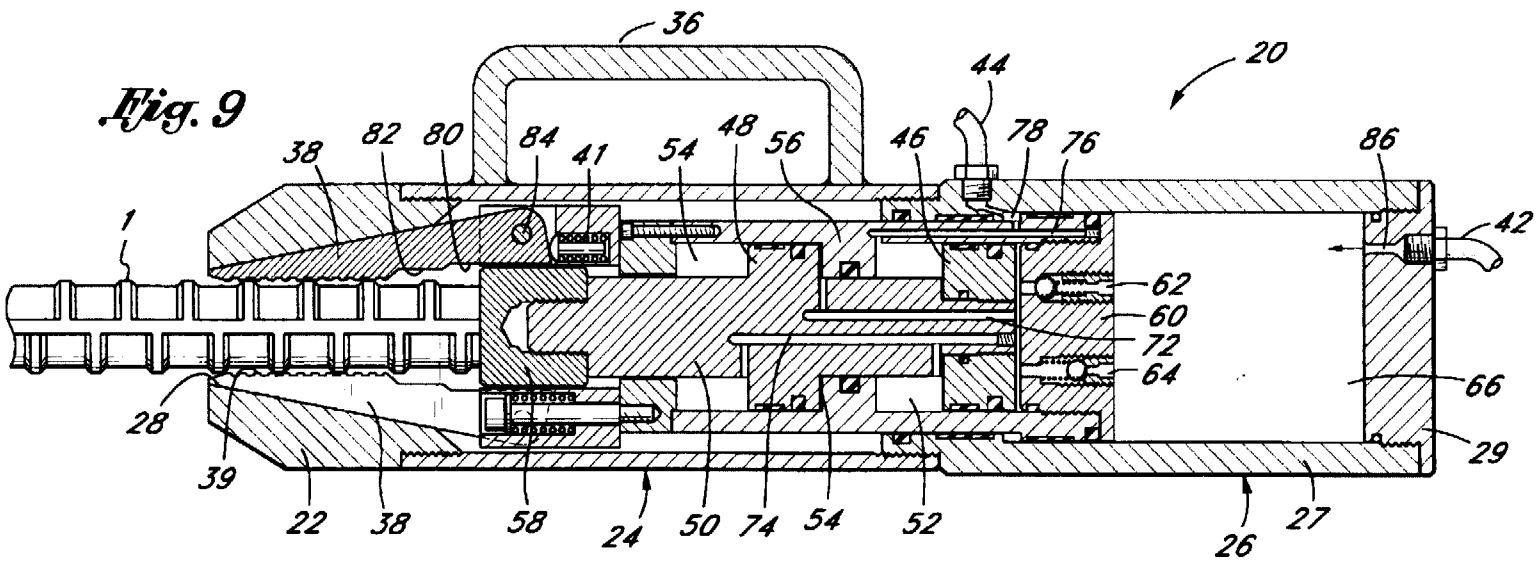
FIG. 9 shows a cross-section of the hydraulic upsetting tool while gripping the protruding end of a reinforcement bar at which an upset head is to be formed.

Referring now to FIG. 9 of the drawings, hydraulic fluid (e.g. oil) is forced through a port 86 in cylinder head 29 that communicates with the rear cylinder 66 within the cylindrical body 27 of the housing 26 of upsetting tool 20. By filling the rear cylinder 66 between cylinder head 29 and the valve body 60 of piston body 56, hydraulic pressure will begin to build within the cylinder 66. The pressure build-up within the rear cylinder 66 of cylindrical body 27 will first urge the piston body 56 to move forwardly through housing 26 towards the protruding end of reinforcement bar 1. Inasmuch as the reinforcement bar 1 is embedded in concrete and cannot be displaced, additional oil flowing into rear cylinder 66 will eventually cause the body 27 of housing 26 as well as the collar 24 and mouth 22 of upsetting tool 20 to slide rearwardly relative to the articulating jaws 38 and the piston body 56. Accordingly, the inwardly sloping mouth 22 of upsetting tool 20 will ride over the articulating jaws 38 so as to automatically urge the jaws 38 to rotate towards and into engagement with the pre-heated end of reinforcement bar 1. At the same time, a spring 41 associated with each jaw will be slightly compressed.

With the sloping mouth 22 now covering the articulating jaws 38 and the teeth 39 of the jaws biting against the protruding end of reinforcement bar 1, the cylindrical body 27 of housing 26 is anchored against further rearward movement and can no longer slide relative to the jaws 38 and piston body 56. Hence, and in response to the continuing build-up of pressure within the rear cylinder 66, one of the check valves 64 of valve body 60 will open. The second check valve 62 will remain closed inasmuch as the fluid pressure within the rear cylinder 66 at one side of valve body 60 is greater than the fluid pressure within the cylinder 52 at the opposite side of valve body 60.

Figure 10:
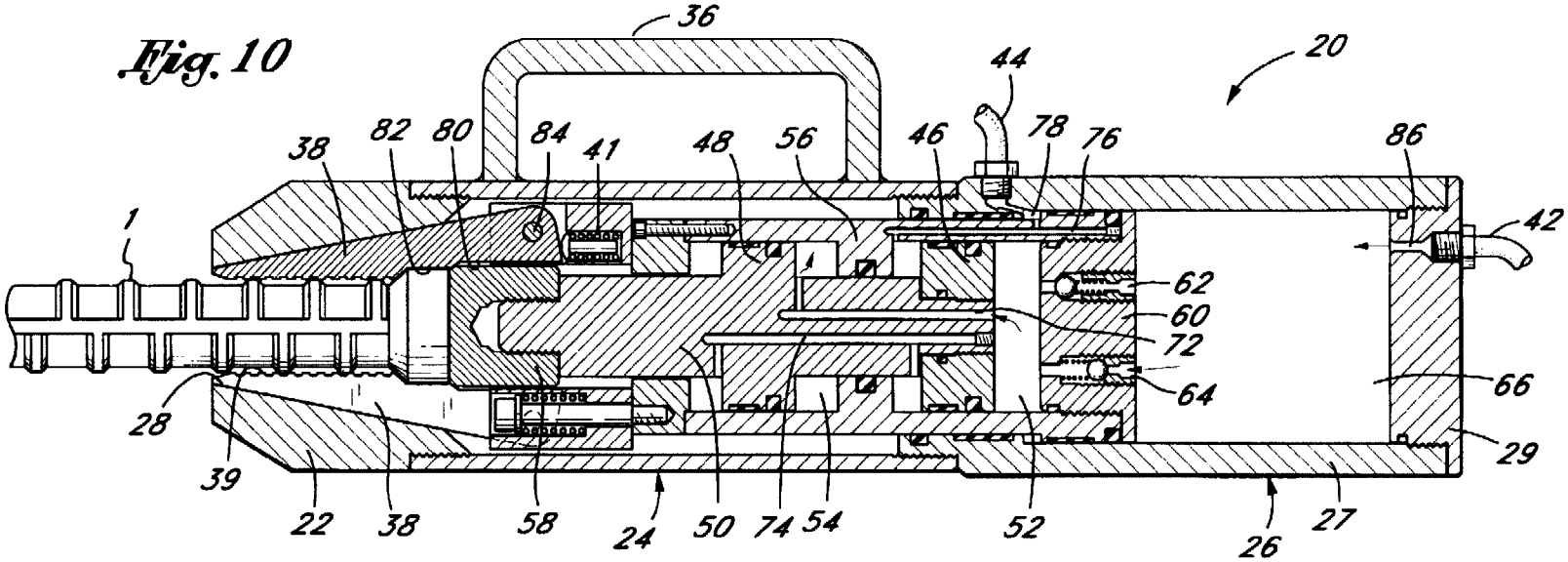
FIG. 10 shows a cross-section of the hydraulic upsetting tool while shaping the upset head at the protruding end of the reinforcement bar.
Figure 11:
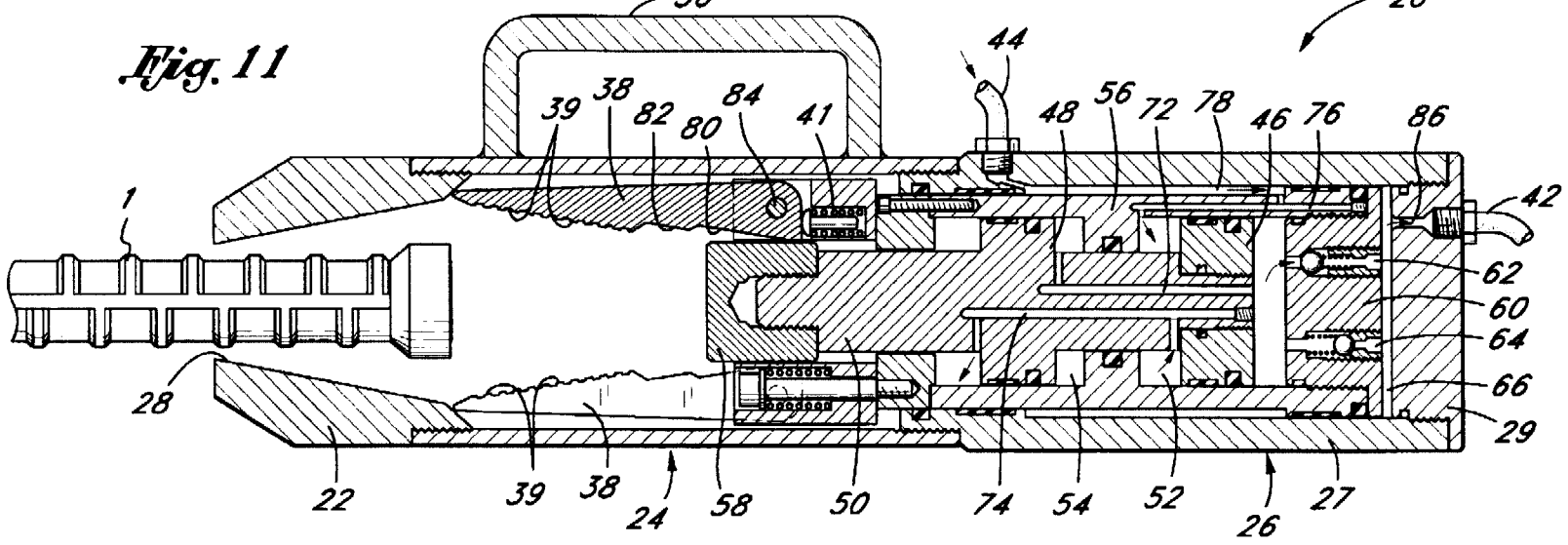
FIG. 11 shows a cross-section of the hydraulic upsetting tool after the upset head has been formed with the protruding end of the reinforcement bar now released and the tool returned to the at rest condition of FIG. 8.

In FIG. 10 of the drawings, oil that has filled the rear cylinder 66 via fluid hose 42 is forced through the open check valve 64 to fill the first of the pair of tandem cylinders 52 of piston body 56. As soon as the first tandem cylinder 52 is filled, oil will be forced therefrom through fluid channel 72 in piston rod 50 to fill the second of the pair of tandem cylinders 54. It may be appreciated that oil fills the pair of tandem cylinders 52 and 54 behind the hydraulic pistons 46 and 48. Therefore, the pistons 46 and 48 are driven forwardly through their respective tandem cylinders 52 and 54 in a direction towards the protruding end of reinforcement bar 1 that has been pre-heated and clamped between the articulating jaws 38.

The forward movement of hydraulic pistons 46 and 48 through tandem cylinders 52 and 54 imparts a corresponding forward movement to the piston rod 50. Inasmuch as the upsetting anvil 58 is affixed to the front of piston rod 50, the forward movement of piston rod 50 is transferred to upsetting anvil 58, whereby upsetting anvil 58 is forced against the pre-heated end of reinforcement bar 1. Accordingly, the bar 1 is compressed between the articulating jaws 38 which are now closed around the bar and the upsetting anvil 58 so as to cause metal at the pre-heated end of the bar 1 to flow into the chamfers 80 and 82 along the inwardly facing sides of the jaws 38. The compressive force applied by upsetting anvil 58 is maintained against the pre-heated end of reinforcement bar 1 for about three to five seconds at approximately 5,000 psi until an upset head 10 is formed which conforms to the shape of the chamfers 80 and 82 of articulating jaws 38.

Once the upset head 10 has been formed at the protruding end of reinforcement bar 1, oil flow through fluid hose 42 into rear cylinder 66 is discontinued and the first check valve 64 closes. Next, oil is drained from the tandem cylinders 52 and 54 through fluid hose 42 to cause the grip established by the articulating jaws 38 against the bar 1 to be released.

More particularly, oil under pressure is injected into the fluid channel 78 from fluid hose 44. Oil is then supplied to each of the pair of tandem cylinders 52 and 54 via a fluid path consisting of fluid channel 78, the first cylinder 52, the fluid channel 74 through piston rod 50 extending between cylinders 52 and 54, and finally the second cylinder 54. In this case, it may be appreciated that oil fills the cylinders 52 and 54 in front of the hydraulic pistons 46 and 48. Hence, the pistons 46 and 48 are driven rearwardly through their respective tandem cylinders 52 and 54 in a direction away from the protruding end of reinforcement bar 1 at which the enlarged upset head 10 has now been formed.

The rearward movement of the pistons 46 and 48 through cylinders 52 and 54 is transferred to the upsetting anvil 58 and to the articulating jaws 38. Eventually, the piston body 56 will slide rearwardly relative to the cylindrical body 27 of housing 26, and the valve body 60 functions as a hydraulic piston to expulse oil from the rear cylinder 66. As a result, the hydraulic pressure in the first of the tandem cylinders 52 behind hydraulic piston 46 and in front of valve body 60 will increase to cause the second check valve 62 to open. Inasmuch as the hydraulic pressure is now greater at the front of valve body 60 than at the rear, the second check valve 62 will remain open while the first check valve 64 remains closed. Therefore, oil within the second of the tandem cylinders 54 behind piston 48 is drained through the fluid hose 42 via fluid channel 72 and check valve 62. In this same regard, oil from the first of the tandem cylinders 52 behind piston 46 is also drained via check valve 62 and hose 42.

By virtue of the foregoing, the piston body 56 which carries the upsetting anvil 58 at the front of piston rod 50 has been moved rearwardly through the rear cylinder 66 and away from the reinforcement rod 1. The previously compressed spring 41 will expand and the spring-controlled articulating jaws 38 will correspondingly rotate apart and away from one another to release the relatively wide upset head 10 at the protruding end of bar 1. At this point the upsetting tool has been returned to the at rest condition of FIG. 8 so that it can now be withdrawn from the headed bar 1 to enable the bar to be coupled to an opposing reinforcement bar by means of the upset head 10 thereof.

Figure 12:
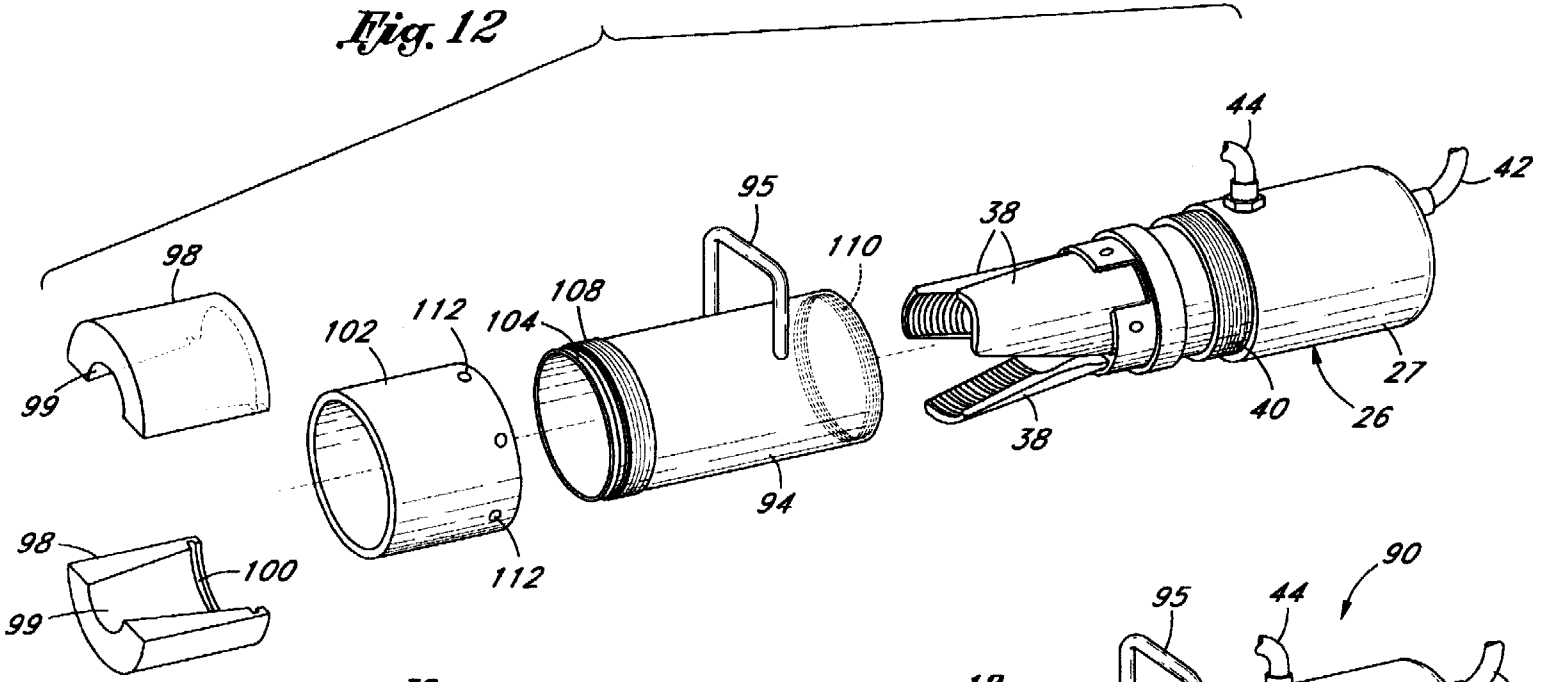
FIG. 12 is an exploded view of a hydraulic upsetting tool which forms an alternate embodiment of the present invention.
Figure 12A:
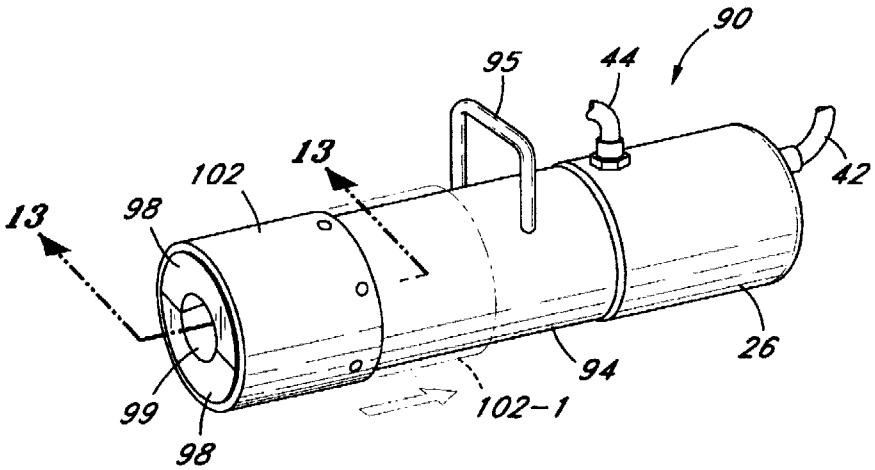
FIG. 12A shows the hydraulic upsetting tool of FIG. 12 in the assembled configuration.
Figure 13:
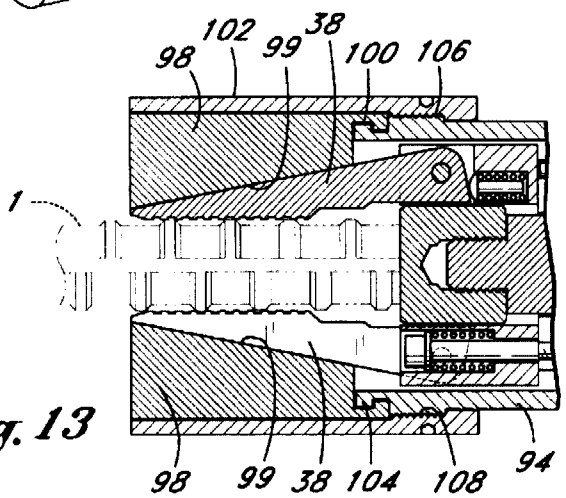
FIG. 13 is a cross-section taken along lines 13—13 of FIG. 12A.

FIGS. 12, 12A and 13 of the drawings illustrate a hydraulic upsetting tool 90 which forms an alternate embodiment of the present invention. Like the upsetting tool 20 of FIGS. 7–11, the upsetting tool 90 includes the detachable interconnection of a mouth 92 to accept the preheated end of a steel reinforcement bar (like that designated by reference numeral 1 in FIGS. 4 and 13), a hollow cylindrical collar 94 having a circumferentially extending carrying handle 95, and a housing 26. The housing 26 of upsetting tools 20 and 90 are identical and, therefore, have identical reference numerals. In this same regard, the housing 26 of upsetting tool 90 has a set of articulating jaws 38 located at one end thereof and a cylindrical body 27 at the opposite end. Fluid hoses 42 and 44 communicate with a hydraulic pump (designated 8 in FIG. 4) to supply and remove oil to and/or from the interior of cylindrical body 27 for generating the hydraulic pressure necessary to form an upset head at the protruding end of reinforcement bar 1.

In accordance with the present embodiment, the mouth 92 of upsetting tool 90 includes a pair of opposing split tapered rings 98. Each split tapered ring 98 has a sloping interior wall 99 (best shown in FIG. 13) and a peripheral groove 100 extending around the inside of the rear end. In the assembled configuration of FIG. 12A, a continuous outer cylindrical ring 102 surrounds the split tapered rings 98 so that the articulating jaws 38 are urged into clamping engagement with the protruding end of the reinforcement bar 1 by the sloping walls 99 of split tapered rings 98 to shape the upset head. The split tapered rings 98 are coupled to the collar 94 when a peripheral lip 104 that extends around the exterior at the front of the collar 94 is received within the peripheral groove 100 of the split tapered rings 98. Moreover, the outer cylindrical ring 102 has a set of peripheral screw threads (designated 106 and best shown in FIG. 13) at the interior thereof which are adapted to be mated to a corresponding set of peripheral screw threads 108 located at the exterior of collar 94 behind the peripheral lip 104 whereby to detachably connect the outer ring 102 to the front of the collar 94. What is more, a set of peripheral screw threads 110 at the interior of collar 94 are adapted to be mated to the peripheral screw threads 40 around the outside of housing 26 whereby to detachably connect the rear of the collar 94 to the housing 26.

By virtue of the foregoing, the mouth 92 of the hydraulic upsetting tool 90 may be easily and quickly disassembled for the purposes of cleaning and repair and removing a reinforcement bar therefrom having a large upset head. More particularly, a conventional gripping tool (not shown) may be inserted into a series of external tool holes 112 that are formed around the outer cylindrical ring 102 in order to rotate the ring 102 relative to the collar 94. Accordingly, the outer ring (designated 102-1 in FIG. 12A) will be displaced rearwardly so as to slide over the front of the collar 94 and thereby allow the opposing split tapered rings 98 to be removed and separated from one another to permit access to and withdrawal of a large headed bar that might otherwise be trapped within the mouth 92. In addition, the use of inner split tapered rings 98 surrounded by the outer cylindrical ring 102 contributes to reducing the overall length of the upsetting tool 90 which is advantageous in producing a compact tool configuration.

It will be apparent that while a preferred embodiment of the invention has been shown and described, various modifications and changes may be made without departing from the true spirit and scope of the invention. For example, although a reinforcement bar has been shown and described as being embedded within a concrete or similar structure, it is to be understood that the present invention is also applicable to upsetting reinforcement bars prior to their being embedded in a structure.

Having thus set forth the preferred embodiment, what is claimed is:

1. A method for upsetting a reinforcement bar so that the reinforcement bar can be connected to an opposing reinforcement bar, said method comprising the steps of:

heating a first end of the reinforcement bar;

gripping said first end by a plurality of rotatable jaws that are adapted to rotate towards and into clamping engagement with said first end to prevent the displacement of the reinforcement bar, said plurality of rotatable jaws also adapted to rotate away from said first end to release the reinforcement bar after said bar is upset;

locating an upsetting block in axial alignment with said first end of the reinforcement bar, said upsetting block being interconnected with a hydraulic piston that is received in and movable reciprocally through a cylinder;

adding hydraulic fluid to said cylinder to generate a hydraulic pressure therein for driving said hydraulic piston in a first direction through said cylinder and correspondingly moving said upsetting block towards and into contact with said first end and thereby form an upset head;

removing said hydraulic fluid from said cylinder and driving said hydraulic piston in an opposite direction through said cylinder for withdrawing said upsetting block from said upset head formed on said first end and the reinforcement bar; and releasing the grip on said first end of the reinforcement bar.

2. The method recited in claim 1, comprising the additional steps of locating a threaded nut around the reinforcement bar before said first end thereof is heated and said upset head is formed; and locating said threaded nut in surrounding engagement with said upset head and coupling said threaded nut to the opposing reinforcement bar.

3. The method recited in claim 1, comprising the additional steps of:

adding a first supply of said hydraulic fluid to said cylinder at one side of said hydraulic piston for driving said hydraulic piston in said first direction through said cylinder and thereby moving said upsetting block towards said first end of the reinforcement bar; and removing said first supply of said hydraulic fluid from said cylinder after said upset head is formed on said first end of the reinforcement bar, and adding a second supply of said hydraulic fluid to said cylinder at the opposite side of said hydraulic piston for driving said hydraulic piston in said opposite direction through said cylinder and thereby withdrawing said upsetting block from said upset head.

4. The method recited in claim 1, comprising the additional step of locating said hydraulic piston at one end of a piston rod and locating said upsetting block at the opposite end of said piston rod so that movements of said hydraulic piston in said first and opposite directions through said cylinder are imparted to said upsetting block to cause said upsetting block to be correspondingly moved towards and withdrawn from said first end of the reinforcement bar.

5. The method recited in claim 1, comprising the additional steps of adding said hydraulic fluid to said cylinder and removing said hydraulic fluid from said cylinder by means of a pair of check valves; and orienting said pair of check valves relative to one another such that a first of said pair of check valves opens to establish a fluid path for supplying said hydraulic fluid to said cylinder from a source of said hydraulic fluid, and the second of said pair of check valves opens to establish a fluid path for returning said hydraulic to said source of hydraulic fluid from said cylinder.

6. The method recited in claim 5, comprising the additional step of locating said pair of check valves in a cylinder head that extends across said cylinder such that each of said fluid paths established by said pair of check valves extends through said cylinder head to communicate with said cylinder.

7. The method recited in claim 1, comprising the additional steps of locating said plurality of jaws in axial alignment with a sloping wall and surrounding said first end of the reinforcement bar by said jaws; and sliding said sloping wall over said plurality of jaws for urging said jaws to rotate towards and into clamping engagement with said first end.

8. The method recited in claim 1, comprising the additional steps of forming at least one chamfer in at least one of said plurality of jaws end shaping said upset head within said at least one chamfer when said jaws are rotated towards and into clamping engagement with said first end of the reinforcement bar and said upsetting block is moved towards and into contact with said first end to compress said first end.

9. An upsetting tool to upset a pre-heated end of a reinforcement bar so that the reinforcement bar can be coupled to an opposing reinforcement bar, said upsetting tool comprising:

an open mouth to receive said pre-heated end of the reinforcement bar therewithin;

a plurality of rotatable jaws to releasably grasp said pre-heated end of the reinforcement bar received within said open mouth, said jaws adapted to rotate towards and into clamping engagement with said pre-heated end to prevent the displacement of the reinforcement bar, and said jaws also adapted to rotate away from said pre-heated end to release the reinforcement bar after said pre-heated end has been upset;

upsetting means located in axial alignment with said pre-heated end of the reinforcement bar and adapted to upset said pre-heated end;

a cylinder;

a hydraulic piston located within and movable reciprocally through said cylinder, said hydraulic piston interconnected with said upsetting means; and hydraulic fluid source means communicating with said cylinder to supply hydraulic fluid to said cylinder to generate a hydraulic pressure therein for driving said hydraulic piston in a first direction through said cylinder for causing said upsetting means to move towards said pre-heated end of the reinforcement bar to compress said pre-heated end and thereby form an upset head, said hydraulic piston being driven in an opposite direction through said cylinder so that said hydraulic fluid is removed from said cylinder and returned to said hydraulic fluid source means for causing said upsetting means to be withdrawn from said upset head.

10. The upsetting tool recited in claim 9, wherein said hydraulic fluid source means communicates with said cylinder at one side of said hydraulic piston to deliver a first supply of said hydraulic fluid to drive said hydraulic piston in said first direction through said cylinder and cause said upsetting means to move towards said pre-heated end of the reinforcement bar, said hydraulic fluid source means also communicating with said cylinder at the opposite side of said hydraulic piston to deliver a second supply of said hydraulic fluid to drive said hydraulic piston in said opposite direction through said cylinder for causing said first supply of said hydraulic fluid to be removed from said cylinder and returned to said hydraulic fluid source means and said upsetting means to be withdrawn from said upset head.

11. The upsetting tool recited in claim 9, further comprising a piston rod interconnected between said hydraulic piston and said upsetting means so that movements of said hydraulic piston in said first and opposite directions through said cylinder are imparted to said upsetting means to cause said upsetting means to correspondingly move towards and be withdrawn from said upset head.

12. The upsetting tool recited in claim 9, wherein said open mouth to receive said pre-heated end of the reinforcement bar has a sloping wall and said plurality of jaws being disposed in axial alignment with said sloping wall, said sloping wall sliding over said plurality of jaws for urging said jaws to move towards and into clamping engagement with said pre-heated end of the reinforcement bar.

13. The upsetting tool recited in claim 9, further comprising at least one chamfer formed in at least one of said plurality of jaws, said upset head being shaped within said at least one chamfer when said jaws move towards and into clamping engagement with said pre-heated end of the reinforcement bar and said upsetting means is moved towards said pre-heated end to compress said pre-heated end and thereby form said upset head.

14. The upsetting tool recited in claim 9, wherein said open mouth includes opposing first and second mouth halves that are detachably connected to one another so as to lie in surrounding engagement with said plurality of jaws.

15. The upsetting tool recited in claim 14, further comprising an outer cover to surround said first and second mouth halves to maintain said mouth halves connected together, said outer cover being slidable relative to said first and second mouth halves to permit said first and second mouth halves to be detached from one another and thereby allow access to said plurality of jaws and to said upset head formed on the reinforcement bar.

16. The upsetting tool recited in claim 9, wherein said hydraulic piston comprises first and second piston members connected in spaced axial alignment with one another and adapted to move in tandem with said upsetting means, said upsetting tool further comprising first and second fluid channels extending between said first and second piston members so as to establish a hydraulic fluid path between said hydraulic fluid source means and each of said first and second piston members for causing said first and second piston members to move reciprocally through said cylinder.

17. The upsetting tool recited in claim 9, further comprising a cylinder head extending across said cylinder and valve means extending through said cylinder head, said cylinder head adapted to move through said cylinder towards and away from said hydraulic piston, said hydraulic fluid being supplied to and removed from said cylinder via said valve means to cause said hydraulic piston to move reciprocally through said cylinder.

18. A method for upsetting a reinforcement bar so that the reinforcement bar can be connected to an opposing reinforcement bar, said method for comprising the steps of:

heating a first end of the reinforcement bar;

gripping said first end to prevent the displacement of the reinforcement bar;

locating an upsetting block in axial alignment with said first end of the reinforcement bar, said upsetting block being interconnected with a hydraulic piston that is received in and movable reciprocally through a cylinder;

locating a cylinder head across said cylinder and positioning a pair of check valves in said cylinder head such that first and second fluid paths are established through said cylinder head so as to communicate with said hydraulic piston;

adding hydraulic fluid to said cylinder from a source thereof via a first of the pair of check valves and said first fluid path to generate a hydraulic pressure therein for driving said hydraulic piston in a first direction through said cylinder and correspondingly moving said upsetting block towards and into contact with said first end of the reinforcement bar to compress said first end and thereby form an upset head;

removing said hydraulic fluid from said cylinder via said second fluid path and the other of said pair of check valves and driving said hydraulic piston in an opposite direction through said cylinder for withdrawing said upsetting block from said upset head formed on said first end of the reinforcement bar; and releasing the grip on said first end of the reinforcement bar.

19. The method recited in claim 18, comprising the additional step of supplying said hydraulic fluid from said source thereof to said cylinder for causing said cylinder head to move through said cylinder and towards said hydraulic piston prior to the step of adding hydraulic fluid to said cylinder via said first check valve and said first fluid path for driving said hydraulic piston in said first direction through said cylinder.

20. The method recited in claim 18, comprising the additional step of gripping the first end of said reinforcement bar by a plurality of rotatable jaws adapted to rotate towards and into clamping engagement with said first end to prevent the displacement of the reinforcement bar, and said plurality of jaws also adapted to rotate away from said first end to release the reinforcement bar after said upset head is formed.

* * * * *